US006293461B1

(12) United States Patent
Rivers, Sr.

(10) Patent No.: US 6,293,461 B1
(45) Date of Patent: Sep. 25, 2001

(54) MAILBOX WITH AUTOMATIC FLAGS

(76) Inventor: Albert A. Rivers, Sr., R.D. 1 Box 104, Ticonderoga, NY (US) 12883

( * ) Notice: Subject to any disclaimer, the term of this patent is extended or adjusted under 35 U.S.C. 154(b) by 0 days.

(21) Appl. No.: 09/410,535

(22) Filed: Oct. 1, 1999

(51) Int. Cl.[7] ..... B65D 91/00
(52) U.S. Cl. ..... 232/35
(58) Field of Search ..... 232/35, 34, 17, 232/45

(56) References Cited

U.S. PATENT DOCUMENTS

| | | | |
|---|---|---|---|
| 1,210,562 | | 1/1917 | Taylor . |
| 1,925,227 | | 9/1933 | Black . |
| 1,929,965 | * | 10/1933 | Black et al. . |
| 2,098,242 | | 11/1937 | Holmes . |
| 2,352,975 | | 7/1944 | Roe . |
| 2,670,897 | * | 3/1954 | Gagnon . |
| 3,013,715 | * | 12/1961 | Ferenci . |
| 3,392,911 | * | 7/1968 | Clark . |
| 3,467,303 | * | 9/1969 | Saatzer . |
| 3,648,924 | * | 3/1972 | Burns . |
| 3,747,839 | | 7/1973 | Morton . |
| 3,960,317 | | 6/1976 | Clement . |
| 4,290,549 | | 9/1981 | Getz, Jr. . |
| 4,552,302 | | 11/1985 | Rung . |
| 4,756,472 | * | 7/1988 | Hammons . |
| 5,082,170 | * | 1/1992 | Goss . |

* cited by examiner

*Primary Examiner*—Anthony Knight
*Assistant Examiner*—William L. Miller
(74) *Attorney, Agent, or Firm*—Schmeiser, Olsen & Watts

(57) ABSTRACT

This device relates generally to a mailbox with a first indicator for signaling the arrival of mail. A second indicator signals that there is outgoing mail to be picked up by a carrier. A first end of the first indicator and a first end of the second indicator are releasably connected to a control member. The control member is attached to a pivoting door of the mailbox.

15 Claims, 4 Drawing Sheets

MAILBOX WITH AUTOMATIC FLAGS

FIELD OF THE INVENTION

The present invention relates generally to mailboxes, and more particularly to mailboxes provided with indicator flags operated by the opening or closing of a door.

BACKGROUND OF THE INVENTION

Mailboxes are commonly provided with a flag to indicate to a mail carrier that the mailbox contains material such as mail to be picked up by the mail carrier. The flag typically is pivotally attached to a side of the mailbox. The flag is manually rotated into an upward position by the user when outgoing mail is placed in the mailbox. The mail carrier picks up the mail and manually rotates the flag downward into a lowered position.

Some related art mailboxes include a pair of flags. A first flag indicates when mail has been delivered. The first flag automatically rises when the mail carrier has opened the door of the mailbox. The first flag may eliminate the inconvenience of a user having to make numerous trips from a house to the mailbox in order to check to see if the mail has arrived. Some mailboxes may provide a further inconvenience to the user by being located at a considerable distance from the house or across a street from the house. The user may make unnecessary trips to the mailbox to determine if material has been delivered. Weather such as rain, sleet, wind or snow cause additional inconvenience. Elderly persons may be needlessly exposed to the risk of physical injury making additional trips to the mailbox during icy weather conditions. A problem may arise when no mail is delivered. When the carrier opens the door to pick up mail, the first flag automatically rises even though no mail may be delivered. The raised flag with an empty mailbox, causes the user to make an unnecessary trip to the mailbox.

A second flag indicates when there is outgoing mail for the mail carrier to pick up. The user raises this second flag to signal the mail carrier to pick up the outgoing mail.

SUMMARY OF THE INVENTION

In order to overcome the above deficiencies, the present invention provides a mailbox with a first indicator and a second indicator. The first indicator signifies that a mail carrier has opened the door of the mailbox. If material has been picked up and no material has been delivered, the mail carrier may easily lower the first indicator by moving a handle conveniently located near the door of the mail box. The second indicator is raised to signal the mail carrier that there is outgoing material awaiting pickup. The second indicator automatically lowers when the mail carrier opens the door to take the outgoing material.

The present invention generally provides an apparatus comprising:

- a housing;
- a door pivotally attached to the housing;
- a control member attached to the door;
- a first indicator apparatus pivotally attached to the housing wherein a first end of the first indicator apparatus is releasably connected to the control member; and
- a second indicator apparatus pivotally attached to the housing wherein a first end of the second indicator apparatus is releasably connected to the control member.

BRIEF DESCRIPTION OF THE DRAWINGS

The features of the present invention will best be understood from a detailed description of the invention and a preferred embodiment thereof selected for the purposes of illustration and shown in the accompanying drawings in which.

DETAILED DESCRIPTION OF THE INVENTION

Figure 1:
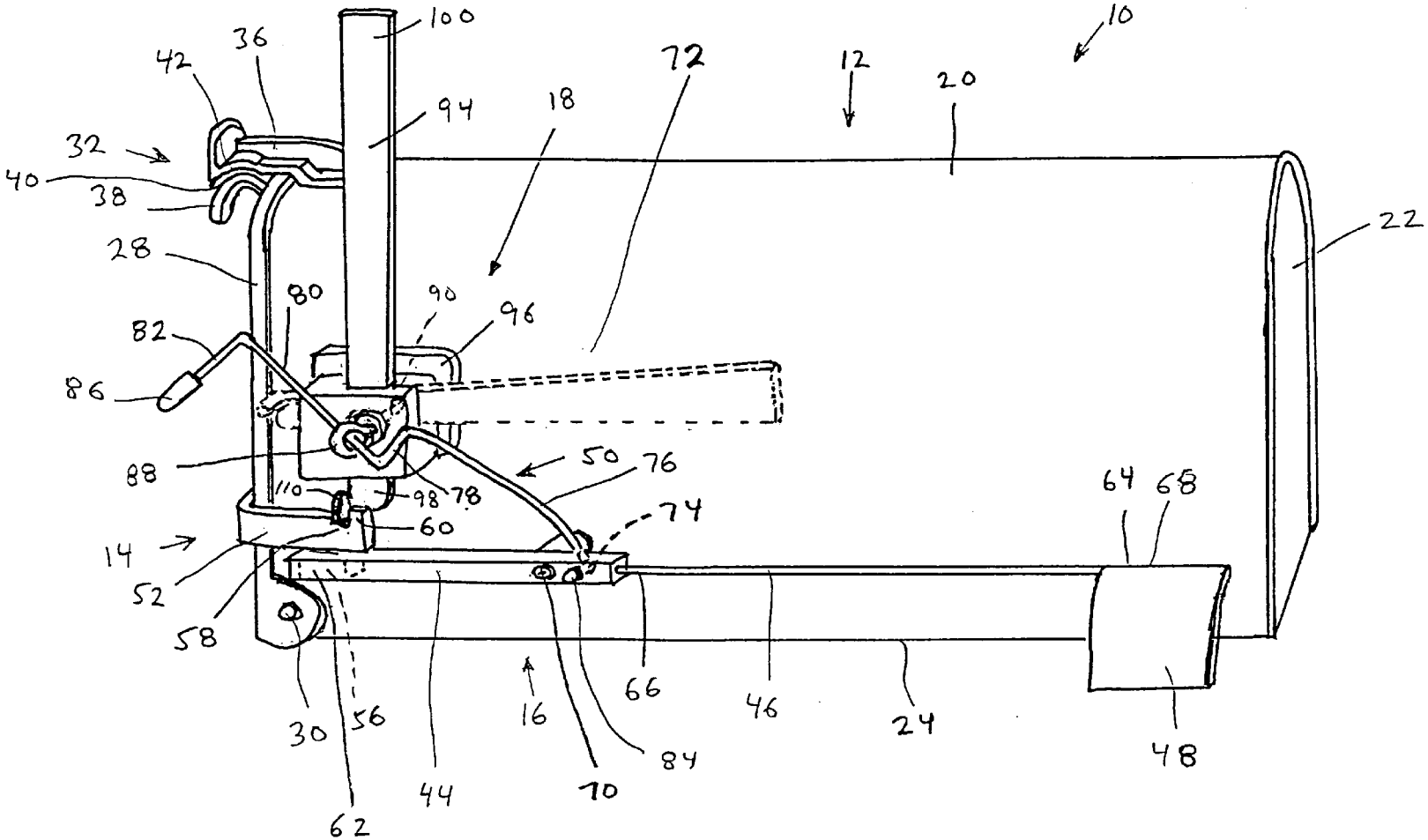
FIG. 1 illustrates a perspective view of a mailbox according to the present invention including a first indicator in a lowered position, and a second indicator in a raised position.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the preferred embodiment. The features and advantages of the present invention are illustrated in detail in the accompanying drawings, wherein like reference numerals refer to like elements throughout the drawings. Although the drawings are intended to illustrate the present invention, the drawings are not necessarily drawn to scale.

FIG. 1 illustrates a perspective view of a mailbox 10 in accordance with the present invention. The mailbox 10 includes a housing 12, an actuating apparatus 14, a first indicator apparatus 16, and a second indicator apparatus 18. The housing 12 includes a cover 20, a rear cover 22, a bottom 24, an opening 26 (FIG. 2), a door 28, and a door latch assembly 32. The door 28 is pivotally attached to the cover 20 of the housing 12 by pin 30. The door 28 is opened and closed to place or remove material (not shown) e.g., mail, letters, packages, boxes, etc. within the mailbox 10. The door latch assembly 32 includes a stationary catch 36, and a door handle 38. The stationary catch 36 is attached to the cover 20 of the housing 12. The door handle 38 is attached to the door 28. An upwardly curving portion 40 of the door handle 38 engages with an inwardly curving portion 42 of the stationary catch 36 to hold the door 28 in a closed position. A mail carrier or a user may grasp and pull the door handle 38 in a direction away from the cover 20 causing the door 28 to open as illustrated in FIG. 2.

Figure 2:
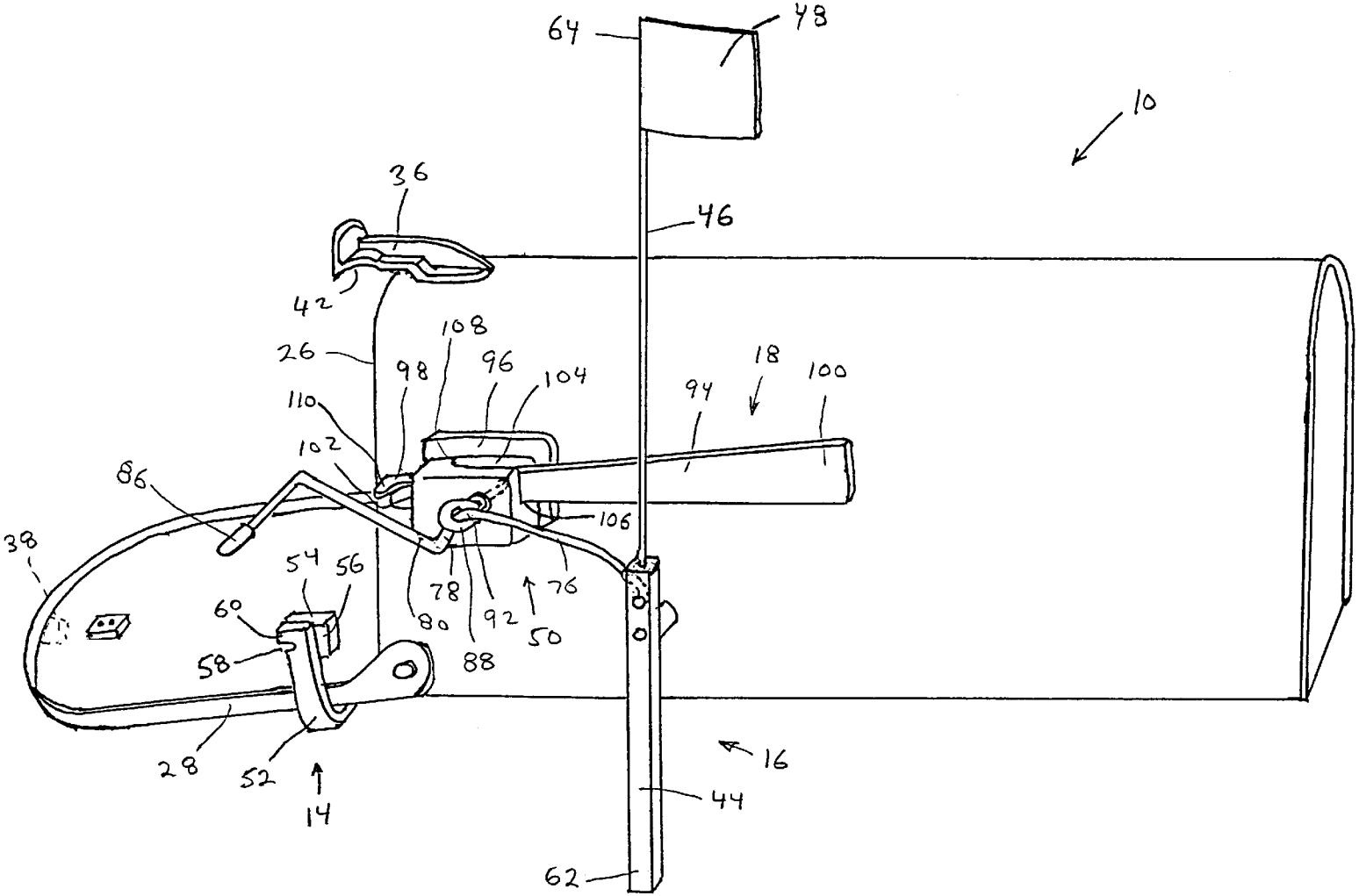
FIG. 2 illustrates a perspective view of the mailbox with the first indicator in a raised position, and with the second indicator in a lowered position.

As illustrated in FIGS. 1 and 2, the actuating apparatus 14 includes a control member 52, and a magnetic body 54. The control member 52 is attached to the door 28. The magnetic body 54 is attached to the control member 52, and a lower portion 56 of the magnetic body 54 protrudes beyond the control member 52. Additionally, the control member 52 includes a notch 58, and a protrusion 60.

The first indicator apparatus 16 includes a body 44, a shaft 46, a flag 48, a first end 62, a second end 64, and a handle assembly 50. A first end 66 of the shaft 46 is connected to the body 44. The flag 48 is attached to a second end 68 of the shaft 46. The flag 48 is located at the second end 64 of the first indicator apparatus 16. The body 44 includes the first end 62 of the first indicator apparatus 16. The body 44 is a suitable material, e.g., steel, iron, etc., that is magnetically attracted to the magnetic body 54. The body 44 including the first end 62 of the first indicator apparatus 16 releasably connects to the lower portion 56 of the magnetic body 54 of the control member 52. The body 44 is pivotally attached by pin 70 to a side 72 of the cover 20.

The handle assembly 50 includes a first section 74, a second section 76, a third section 78, a fourth section 80, and a fifth section 82. The first section 74 of the handle assembly 50 is pivotally attached by a pin 84 to the body 44 of the first indicator apparatus 16. The second section 76 is connected to the first section 74.

The third section 78 is connected to the second section and is substantially perpendicular to the second section 76. The fourth section 80 is connected to the third section 78 and is substantially perpendicular to the third section 78 as illustrated in FIG. 1. The fifth section 82 is connected to the fourth section 80 and is substantially prependicular to the fourth section 80. A soft end piece 86 is attached to the fifth section 82 to provide a soft gripping surface for a user to grasp the end of the handle assembly 50. As illustrated in FIG. 1, the fourth section 80 passes through a loop 88 when the first indicator apparatus 16 lies in a lowered position. The loop 88 is attached to a pin 90 that is pivotally attached to the side 72 of the cover 20.

As illustrated in FIG. 2, the first indicator apparatus 16 is in an upright raised position. A junction 92 of the second section 76 and the third section 78 of the handle assembly 50 rests in the loop 88. To lower the first indicator apparatus 16, the user grasps the soft piece end 86 of the handle assembly 50. Next, the user lifts the soft piece end 86 in an upward direction until the fourth section 80 is in contact with loop 88. Next, the user displaces the soft piece end 86 of the handle assembly 50 towards the rear cover 22 of the mailbox 10. The fourth section 80 slides through the loop 88 lowering the flag as illustrated in FIG. 1. With the door 28 in a closed position, the first end 62 of the body 44 comes in contact with the lower portion 56 of the magnetic body 54 of the control member 52. The body 44 and the magnetic body 54 are magnetically coupled holding the first indicator apparatus 16 in a lowered position. This magnetic coupling is broken when the door 28 is opened. The opening of the door 28 pulls the lower portion 56 of the magnetic body 54 away from the body 44, and frees the first indicator apparatus 16 to swing into a raised position.

When free, the first indicator apparatus 16 automatically rotates into a raised position. Any suitable means such coiled spring (not shown) or counterweight may be used to apply a counterclockwise rotational torque to the first indicator apparatus 16. Preferably, in the present invention, the weight of the body 44 is used as a counterweight. The weight of the body 44 is greater than the weight of the shaft 46 and the flag 48. Thus, the force of gravity acting on the body 44 causes the first indicator apparatus 16 to rotate into a raised position.

Figure 3:
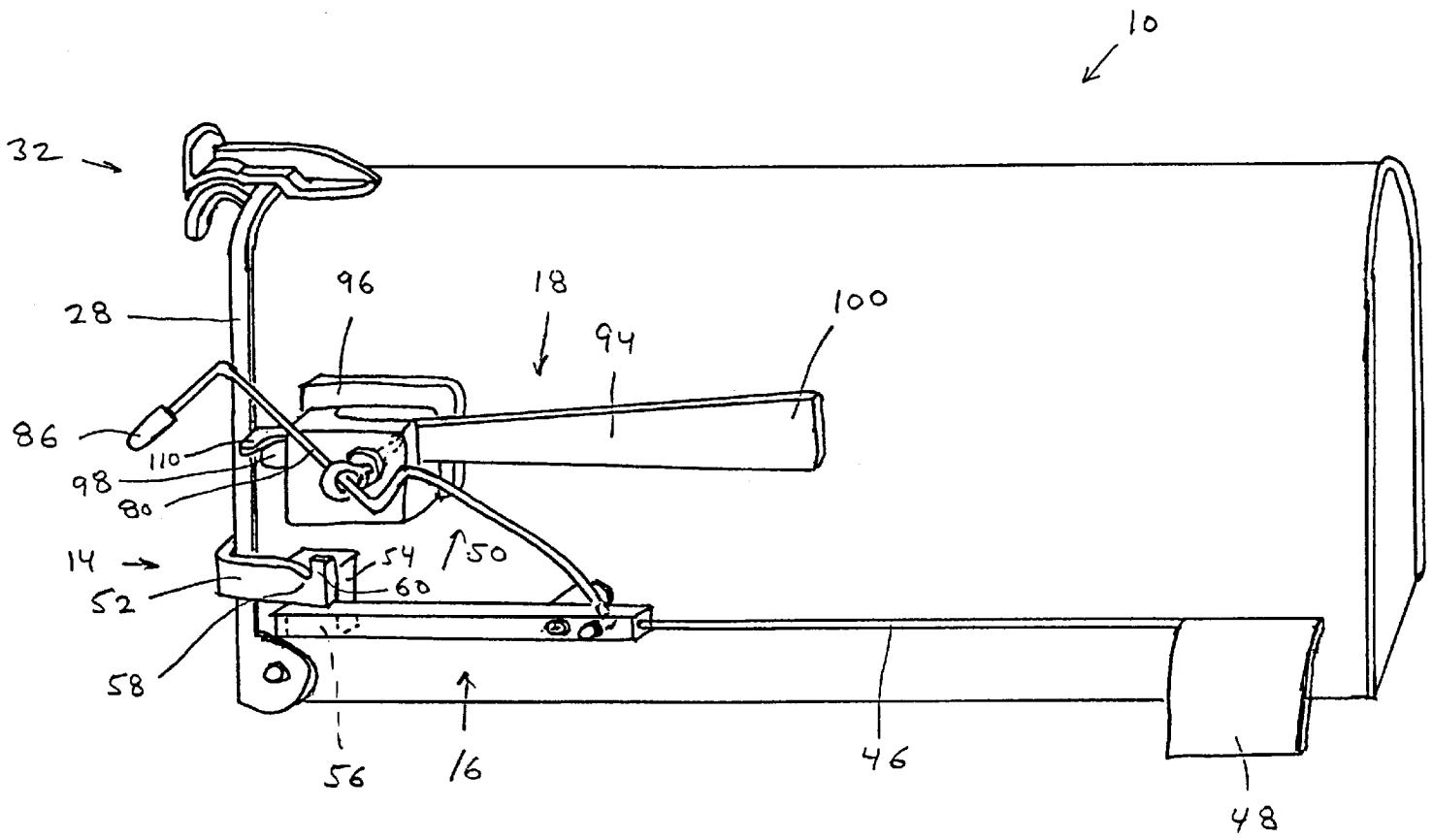
FIG. 3 illustrates a perspective view of the mailbox with both the first indicator and the second indicator in a lowered position.

As illustrated in FIGS. 1, 2, and 3, the second indicator apparatus 18, includes an outgoing mail flag 94, and a base 96. The outgoing mail flag 94 includes a first end 98 and a second end 100. The outgoing mail flag 94 is pivotally mounted to the side 72 of the cover 20 by the pin 90. This is the same pin 90 that is attached to the loop 88. Any suitable means such as a coiled spring (not shown) or counterweight may be used to apply a clockwise rotational torque to the second indicator apparatus 18. Preferably, in the present invention, the weight of the outgoing mail flag 94 is used as a counterweight. The weight of the outgoing mail flag towards the second end 100 is greater than the weight of the first end 98. Thus, the outgoing mail flag 94 automatically rotates in a clockwise direction into a lowered position as illustrated in FIG. 2.

The pin 90 passes through the base 96, through the outgoing mail flag 94, and is pivotally attached to the side 72 of the cover 20. The base 96 includes a first slot 102 through which the first end 98 of the outgoing mail flag 94 protrudes. The second end 100 of the outgoing mail flag 94 protrudes through a second slot 104 in the base 96. A first end 106 of the second slot 104 (FIG. 2), stops the clockwise rotation of the outgoing mail flag 94 in a lowered position. A second end 108 of the second slot 104 allows the counterclockwise rotation of the outgoing mail flag 94 into a counterclockwise raised position.

The first end 98 of the outgoing mail flag 94, includes a protruding tab 110 as illustrated in FIGS. 1 and 2. For rotating the outgoing mail flag 94 of the second indicator apparatus 18 into a raised position, a user closes the door 28 of the mailbox 10. Next, the user rotates the outgoing mail flag 94 in a counterclockwise direction until the protruding tab 110 enters the notch 58 of the control member 52. This holds the outgoing mail flag 94 in a raised position until the door 28 is opened.

When the door 28 is opened, the protrusion 60 of the control member 52 pushes the protruding tab 110 of the first end 98 of the outgoing mail flag 94 in a direction towards the opening 26 of the mailbox 10. This releases the protruding tab 110 from the notch 58 of the control member 52 and starts the rotation of the outgoing mail flag 94 in a clockwise direction. Since the weight of the outgoing mail flag towards the second end 100 is greater than the weight of the first end 98, the outgoing mail flag 94 automatically rotates in a clockwise direction to into a lowered position as illustrated in FIG. 2.

When a user has material to be picked up by the mail carrier, the user opens the door 28 of the mailbox 10 and places the material into the mailbox 10. Next, the user closes the door 28 and rotates the outgoing mail flag 94 of the second indicator apparatus 18 in a counterclockwise direction until the protruding tab 110 enters the notch 58 of the control member 52. This positions the outgoing mail flag 94 into a raised position as illustrated in FIG. 1. Next, the user rotates the first indicator apparatus 16 in a clockwise direction and magnetically secures the first end of the body 44 against the lower portion 56 of the magnetic body 54 of the control member 52. This secures the first indicator apparatus 16 in a lowered position as shown in FIG. 1.

When the mail carrier arrives and opens the door 28 of the mailbox 10, the control member 52 releases the protruding tab 110 of the outgoing mail flag 94 of the second indicator apparatus 18 and releases the body 44 of the first indicator apparatus 16. The outgoing mail flag 94 of the second indicator apparatus 18 rotates into a lowered position as illustrated in FIG. 2. The first indicator apparatus 16 rotates into a raised position (FIG. 2). The mail carrier removes the material to be picked up from the mailbox 10. Next, the carrier places material to the delivered into the mailbox and closes the door 28. After the carrier leaves, the raised first indicator apparatus 16 including the flag 48 indicates that mail has been delivered. The user may then go to the mailbox to retrieve the delivered material. Next, the user rotates the first indicator apparatus 16 into a lowered position (FIG. 3).

If the mail carrier opens the door 28 to pick up mail, and there is no mail to be delivered, the carrier lowers the first indicator apparatus 16. When the door 28 is opened, the first indicator apparatus 16 is automatically raised. To lower the first indicator apparatus 16, the mail carrier first lifts the soft end piece 86 of the handle assembly 50. Then the mail carrier moves the soft end piece 86 of the handle assembly 50 in a direction towards the rear cover 22 of the mailbox which lowers the first indicator apparatus 16. The first indicator apparatus 16 is secured in a lowered position when the body 44 of the first indicator apparatus 16 is connected with the lower portion 56 of the magnetic body 54 of the control member 52. This secures the first indicator apparatus 16 in a lowered position, so that the user does not have to travel to the empty mailbox 10.

When material is delivered by the mail carrier, the first indicator apparatus 16 is automatically raised when the door 28 is opened. The user then sees the raised flag 48 of the first indicator apparatus 16 and may go to pick up the material. The user opens the door 28 of the mailbox 10, removes the material, and closes the door 28. Next, the user lowers the first indicator apparatus 16 and releasably connects the body 44 of the first indicator apparatus 16 to the magnetic body 54 of the control member 52. This holds the first indicator apparatus 16 in a lowered position.

Figure 4:
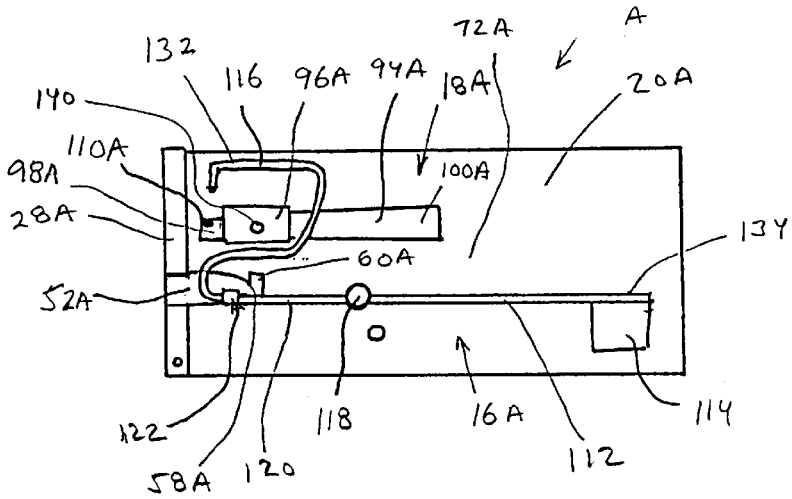
FIG. 4 illustrates a side view of another embodiment of a mailbox including a first indicator in a lowered position, and a second indicator in a lowered position.
Figure 5:
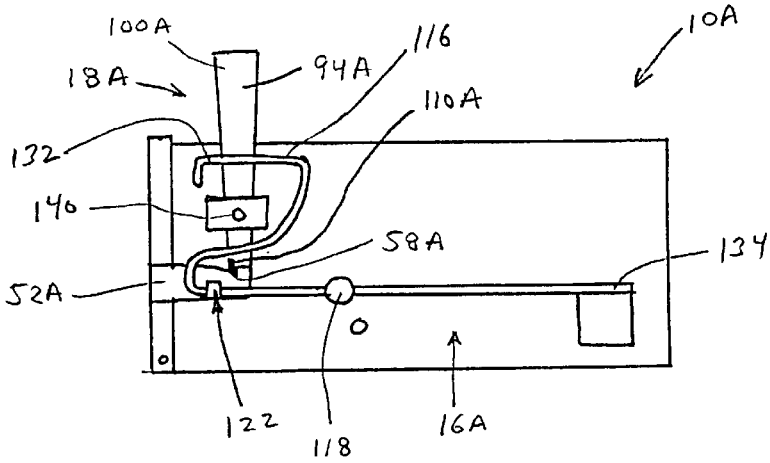
FIG. 5 illustrates a side view of the mailbox with the first indicator in a lowered position, and with the second indicator in a raised position.
Figure 7:
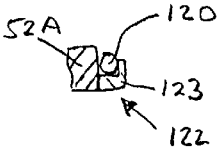
FIG. 7 illustrates a cross-sectional view of a control member including a curved protruding tab to hold a portion of a arm.
Figure 6:
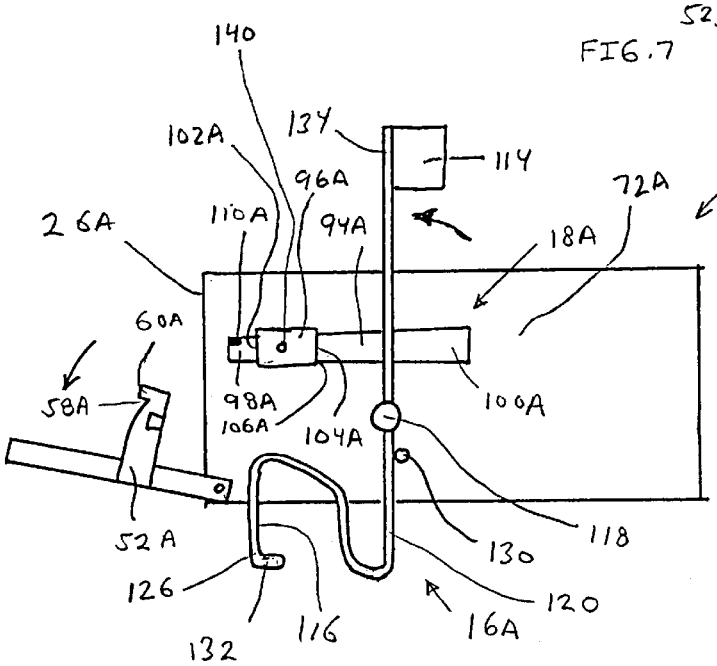
FIG. 6 illustrates a side view of the mailbox with the first indicator in a raised position, and with the second indicator in a lowered position.

Another embodiment a mailbox 10A including a first indicator apparatus 16A and a second indicator apparatus 18A is illustrated in FIGS. 4, 5 and 6. The first indicator apparatus 16A includes a flag shaft 112, a flag 114, a handle 116 and a bushing 118. A first end 132 of the first indicator apparatus 16A includes the handle 116. A second end 134 of the second indicator apparatus 18A includes the flag 114. The flag 114 is attached to the flag shaft 112 and the flag shaft 112 is attached to the bushing 118. A first portion 120 of the handle 116 is attached to the bushing 118. The bushing 118 is pivotally attached to a side 72A of a cover 20A of the mailbox 10A. The first portion 120 of the handle 16 is releasably connected by a latch 122 to a control member 52A. The latch 122 may be any suitable means such as a magnetic or a mechanical coupling. The mechanical coupling may include a curved protruding tab 123 that captures the first portion 120 of the handle 16 as illustrated in FIG. 7. The control member 52A is attached to the door 28A of the mailbox 10A. When the door 28A is opened, the latch 122 releases the first portion 120 of the handle 16 and the first indicator apparatus 16A is free to rotate into a raised position. The weight of the handle 116 is greater than the weight of the flag shaft 112 and the flag 114. Therefore, when free, the weight of the handle 116 will cause the first indicator apparatus 16A to rotate counterclockwise into a raised position as illustrated in FIG. 6. The handle 116 may contact a stop 130 attached to the cover 20A. The handle 116 contacts the stop 130 when the first indicator apparatus 16A is in a raised upright position.

The second indicator apparatus 18A is similar to the second indicator apparatus 18 described above. The second indicator apparatus 18A includes an outgoing mail flag 94A and a base 96A. The outgoing mail flag 94A includes a first end 98A and a second end 100A. Preferably, in the present invention, the weight of the outgoing mail flag towards the second end 100A is greater than the weight of the first end 98A. Thus, the outgoing mail flag 94A automatically rotates in a clockwise direction into a lowered position as illustrated in FIG. 4.

As illustrated in FIG. 6, the outgoing mail flag 94A is pivotally attached by a pin 140 to the side 72A of the cover 20A of the mailbox 10A. The pin 140 passes through the base 96A, through the outgoing mail flag 94A and attaches to the side 72A of the cover 20A. The base 96A includes a first slot 102A through which the first end 98A of the outgoing mail flag 94A protrudes. The second end 100A of the outgoing mail flag 94A protrudes through a second slot 104A in the base 96A. A first end 106A of the second slot 104A stops the clockwise rotation of the outgoing mail flag 94A in a lowered position.

The first end 98A of the outgoing mail flag includes a protruding tab 110A. For rotating the outgoing mail flag 94A of the second indicator apparatus 18A into a raised position, a user closes the door 28A of the mailbox 10A. Next, the user rotates the outgoing mail flag 94A until the protruding tab 100A enters a notch 58A in the control member 52A. This holds the outgoing mail flag 94A in a raised position as illustrated in FIG. 5.

When the door 28A is opened, a protrusion 60A of the control member 52A pushes on the protruding tab 110A of the first end 98A of the outgoing mail flag 94A in a direction towards an opening 26A of the mailbox 10A. This releases the protruding tab 110A from the notch 58A of the control member 52A and starts the rotation of the outgoing mail flag 94 in a clockwise direction. Since the weight of the outgoing mail flag towards the second end 100A is greater than the weight of the first end 98A, the outgoing mail flag 94A automatically rotates in a clockwise direction into a lowered position as illustrated in FIG. 6.

When a user has material to be picked up by the mail carrier, the user opens the door 28A of the mailbox 10A and places the material into the mailbox 10A. Next, the user closes the door 28A and rotates the outgoing mail flag 94A of the second indicator apparatus 18A in a counterclockwise direction until the protruding tab 110A enters the notch 58A of the control member 52A. This positions the outgoing mail flag 94A into a raised position as illustrated in FIG. 5. Next, the user rotates the first indicator apparatus 16A in a clockwise direction and secures the first portion 120A of the handle 116 with the latch 122 of the control member 52. This secures the first indicator apparatus 16A in a lowered position as shown in FIG. 4.

When the mail carrier arrives and opens the door 28A of the mailbox 10A, the control member 52A releases the protruding tab 110A of the outgoing mail flag 94*a* of the second indicator apparatus 18A and releases the first portion 120A of the handle 116 of the first indicator apparatus 16A. The second indicator apparatus 18A rotates into a lowered position as illustrated in FIG. 5. The first indicator apparatus 16A rotates into a raised position (FIG. 6). The mail carrier removes the material to be picked up from the mailbox 10A. Next, the carrier places material to the delivered into the mailbox and closes the door 28A. After the mail carrier leaves, the raised first indicator apparatus 16A including the flag 114 indicates that material has been delivered. The user may then go to the mailbox 10A to retrieve the delivered material. Next, the user rotates the first indicator apparatus 16*a* into a lowered position (FIG. 4).

If the mail carrier opens the door 28A to pick up the outgoing material, and there is no incoming material to be delivered, the carrier lowers the first indicator apparatus 16A. When the door 28A is opened, the first indicator apparatus 16A is automatically raised. To lower the first indicator apparatus 16A, the mail carrier first lifts an end 126 of the handle 116 and couples the first portion 120 of the handle 116 with the latch 122 of the control member 52A. This secures the first indicator apparatus 16A in a lowered position, so that the user does not have to travel to the empty mailbox 10A.

When material is delivered by the mail carrier, the first indicator apparatus 16A is automatically raised when the door 28A is opened. The user then sees the raised flag 114 of the first indicator apparatus 16A and may go to pick up the material. The user opens the door 28A of the mailbox 10A, removes the material, and closes the door 28A. Next, the user lowers the first indicator apparatus 16A and latches the first portion 120 of the handle 116 onto the latch 122 of the control member 52A. The first indicator apparatus 16A is releasably connected to the control member 52A.

The foregoing description of the present invention has been presented for purposes of illustration and description. It is not intended to be exhaustive or to limit the invention to the precise form disclosed, and many modifications and variations are possible in light of the above teaching. For example, the mailbox with automatic flags may also be used as a child's toy. Such modifications and variations that may be apparent to a person skilled in the art are intended to be included within the scope of this invention as defined by the accompanying claims.

I claim:

1. An apparatus comprising:

a housing;

a door pivotally attached to the housing;

a control member attached to the door;

a first indicator apparatus pivotally attached to the housing wherein a first end of the first indicator apparatus is releasably connected to the control member;

a resetting device operatively attached to the first indicator apparatus; and a second indicator apparatus pivotally attached to the housing wherein a first end of the second indicator apparatus is releasably connected to the control member.

2. The apparatus of claim 1, further including a system for raising a second end of the first indicator apparatus.

3. The apparatus of claim 2, wherein the system for raising the second end of the first indicator apparatus further includes the first end of the first indicator apparatus being weighted.

4. The apparatus of claim 1, wherein the resetting device is a handle.

5. The apparatus of claim 4, wherein the handle is pivotally attached to the housing.

6. The apparatus of claim 1, further including a system for lowering a second end of the second indicator apparatus.

7. The apparatus of claim 6, wherein the system for lowering the second end of the second indicator apparatus further includes the second end of the second indicator apparatus being weighted.

8. The apparatus of claim 1, wherein the first end of the first indicator apparatus is releasably connected to the control member by a magnetic coupling.

9. The apparatus of claim 1, wherein the first end of the first indicator apparatus is releasably connected to the control member by a latch.

10. The apparatus of claim 1, wherein the first end of the second indicator apparatus is releasably connected to the control member by a protruding tab on the second indicator apparatus received in a notch of the control member.

11. The apparatus of claim 1, wherein the first indicator apparatus further includes a flag.

12. The apparatus of claim 11, wherein the first indicator apparatus and the second indicator apparatus are attached to a same side of the housing.

13. The apparatus of claim 1, wherein the door selectively covers and uncovers an opening in the housing.

14. The apparatus of claim 1, wherein the apparatus is a mailbox and wherein the first indicator apparatus is automatically raised when the door is opened and the second indicator apparatus is automatically lowered when the door is opened.

15. The apparatus of claim 1, wherein the control member simultaneously releases the first end of the first indicator apparatus and the first end of the second indicator apparatus causing the first indicator apparatus to rotate upward and the second indicator apparatus to rotate downward.

* * * * *